US009797276B2

(12) United States Patent
Tewes et al.

(10) Patent No.: US 9,797,276 B2
(45) Date of Patent: Oct. 24, 2017

(54) SYSTEM FOR VARYING CYLINDER VALVE TIMING IN AN INTERNAL COMBUSTION ENGINE

(71) Applicant: HUSCO Automotive Holdings LLC, Waukesha, WI (US)

(72) Inventors: Allen Tewes, Waukesha, WI (US); Austin Schmitt, Menomonee Falls, WI (US); Brian Heidemann, Lake Mills, WI (US); Dean Wardle, Oconomowoc, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 179 days.

(21) Appl. No.: 14/808,685

(22) Filed: Jul. 24, 2015

(65) Prior Publication Data

US 2015/0330268 A1 Nov. 19, 2015

Related U.S. Application Data

(63) Continuation-in-part of application No. 13/792,396, filed on Mar. 11, 2013, now Pat. No. 9,115,610.

(51) Int. Cl.

| | |
|---|---|
| ***F01L 1/34*** | (2006.01) |
| ***F01L 1/344*** | (2006.01) |
| ***F01L 1/46*** | (2006.01) |

(52) U.S. Cl.

CPC ..... *F01L 1/344* (2013.01); *F01L 1/3442* (2013.01); *F01L 1/462* (2013.01); *F01L 2001/3443* (2013.01); *F01L 2001/34489* (2013.01)

(58) Field of Classification Search

CPC ..... F01L 1/3442; F01L 1/462; F01L 1/344; F01L 2001/3443; F01L 2001/34489

See application file for complete search history.

(56) References Cited

U.S. PATENT DOCUMENTS

| | | | |
|---|---|---|---|
| 4,762,097 | A | 8/1988 | Baker |
| 5,119,691 | A | 6/1992 | Lichti et al. |
| 6,055,950 | A | 5/2000 | Schafer et al. |

(Continued)

FOREIGN PATENT DOCUMENTS

| | | | |
|---|---|---|---|
| DE | 19844669 | A1 | 3/2000 |
| DE | 102013213132 | A1 | 1/2015 |

(Continued)

OTHER PUBLICATIONS

European Search Report; EP 14157288.3; 5 pages; dated Jul. 14, 2014.

(Continued)

*Primary Examiner* — Zelalem Eshete
(74) *Attorney, Agent, or Firm* — Quarles & Brady LLP

(57) ABSTRACT

A control system for varying cylinder valve timing of an internal combustion engine is provided. The control system includes a cam phase actuator having first and second actuator ports to adjust a rotational phase of a camshaft relative to a crankshaft, a first control valve, a second control valve, and a dynamic regeneration valve. In one embodiment, the dynamic regeneration valve is configured to enable the cam phase actuator to switch between operating in an oil pressure actuated mode and a cam torque actuated mode when adjusting the rotational phase of the camshaft relative to the crankshaft.

41 Claims, 7 Drawing Sheets

(56) References Cited

U.S. PATENT DOCUMENTS

| | | | | |
|---|---|---|---|---|
| 6,640,834 | B1 | 11/2003 | Hamkins et al. | |
| 6,899,068 | B2 | 5/2005 | Nan et al. | |
| 7,000,580 | B1 | 2/2006 | Smith et al. | |
| 7,007,925 | B2 | 3/2006 | Nordstrom et al. | |
| 7,444,254 | B2 | 10/2008 | Tsukada et al. | |
| 7,444,971 | B2 | 11/2008 | Suga et al. | |
| 8,205,585 | B2 | 6/2012 | Toda et al. | |
| 8,245,675 | B2 | 8/2012 | Tomimatsu et al. | |
| 8,261,704 | B2 | 9/2012 | Takemura | |
| 8,316,889 | B2 | 11/2012 | Hoppe et al. | |
| 2003/0070713 | A1 | 4/2003 | Cornea et al. | |
| 2007/0221149 | A1 | 9/2007 | Ruiz | |
| 2007/0251474 | A1 | 11/2007 | Gauthier et al. | |
| 2007/0266976 | A1* | 11/2007 | Nagashima | F01L 1/3442 123/90.17 |
| 2008/0257288 | A1 | 10/2008 | Takahashi et al. | |
| 2010/0084019 | A1 | 4/2010 | Burke | |
| 2010/0251980 | A1 | 10/2010 | Ushida et al. | |
| 2011/0005481 | A1 | 1/2011 | Dinkel et al. | |
| 2012/0222634 | A1 | 9/2012 | Dinkel et al. | |
| 2012/0318221 | A1* | 12/2012 | Scheidig | F01L 1/3442 123/90.15 |

FOREIGN PATENT DOCUMENTS

| | | | |
|---|---|---|---|
| EP | 1400661 | A1 | 3/2004 |
| GB | 2472054 | A | 1/2011 |
| JP | 2000027611 | A | 1/2000 |
| WO | 2007107426 | A1 | 9/2007 |
| WO | 2009152880 | A1 | 12/2009 |

OTHER PUBLICATIONS

European Patent Office, Extended European Search Report, Application No. 16275101.0, dated Nov. 25, 2016.

* cited by examiner

SYSTEM FOR VARYING CYLINDER VALVE TIMING IN AN INTERNAL COMBUSTION ENGINE

CROSS-REFERENCE TO RELATED APPLICATIONS

This application is a continuation-in-part of U.S. patent application Ser. No. 13/792,396 filed on Mar. 11, 2013, entitled "System for Varying Cylinder Valve Timing in an Internal Combustion Engine," which is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention relates to variable cylinder valve timing systems for internal combustion engines, and in particular to apparatus for hydraulically operating an actuator that varies a phase relationship between a crankshaft and a cam shaft.

2. Description of the Related Art

Internal combustion engines have a plurality of cylinders containing pistons that are connected to drive a crankshaft. Each cylinder has two or more valves that control the flow of air into the cylinder and the flow of exhaust gases therefrom. The valves were operated by a cam shaft which is mechanically connected to be rotated by the crankshaft. Gears, chains, or belts have been used to couple the crankshaft to the cam shaft. It is important that the valves open and close at the proper times during the combustion cycle of each cylinder. Heretofore, that valve timing relationship was fixed by the mechanical coupling between the crankshaft and the cam shaft.

The fixed setting of the valve timing often was a compromise that produced the best overall operation at all engine operating speeds. However, it has been recognized that optimum engine performance can be obtained if the valve timing varies as a function of engine speed, engine load, and other factors. With the advent of computerized engine control, it became possible to determine the optimum cylinder valve timing based on current operating conditions and in response adjust that timing accordingly.

An exemplary variable cylinder timing system is shown in FIG. 1, in which an engine computer 11 determines the optimum valve timing and applied electric current to a four-way electrohydraulic valve 10 that controls the flow of pressurized oil from a pump 13 to a cam phase actuator 12. The pump 13 typically is the conventional one used to send lubricating oil through the engine. The cam phase actuator 12 couples the cam shaft 14 to a pulley 16 that is driven by a timing belt which engages another pulley on the crankshaft of the engine. Instead of a pulley, a chain sprocket, a gear, or other device may be employed to mechanically couple the cam shaft 14 to the crankshaft. A sensor 15 provides an electrical feedback signal to the engine computer 11 indicating the angular phase of the cam shaft 14.

With additional reference to FIG. 2, the cam phase actuator 12 has a rotor 20 secured to the cam shaft 14. The cam phase actuator 12 has four vanes 22 projecting outward into four chambers 25 in the timing belt pulley 16, thereby defining first and second cavities 26 and 28 in each chamber on opposite sides to the respective vane. A first port 18 in the actuator manifold 15 is connected by a first passageway 30 to the first cavities 26 and a second passageway 33 couples a second port 19 to the second cavities 28.

By selectively controlling the application of engine oil to the first and second ports 18 and 19 of the cam phase actuator 12, the angular phase relationship between the rotating pulley 16 and the cam shaft 14 can be varied to either advance or retard the cylinder valve timing. When the electrohydraulic valve 10 is energized into the center, or neutral, position, fluid from the pump 10 is fed equally into both the first and second cavities 26 and 28 in each timing pulley chamber 25. The equal pressure on both sides of the rotor vanes 22 maintains the present position of those vanes in the pulley chambers 25. The electrohydraulic valve 10 operates in the center position the majority of the time that the engine is running Note that electric current has to be applied to the electrohydraulic valve 10 to maintain this centered position.

In another position of the electrohydraulic valve 10, pressurized oil from the pump 13 is applied to the first port 18 and other oil is exhausted from the second port 19 to a reservoir 17 (e.g., the oil pan). That pressurized oil is conveyed into the first cavities 26, thereby forcing the rotor 20 clockwise with respect to the timing belt pulley 16 and advancing the valve timing. In yet another position of electrohydraulic valve 10, pressurized oil from the pump is applied to the second port 19, while oil is exhausted from the first port 18 to the reservoir 17. Now pressurized oil is being sent into the second cavities 28, thereby forcing the rotor 20 counterclockwise with respect to the timing belt pulley 16, which retards the valve timing.

References herein to directional relationships and movement, such as left and right, or clockwise and counterclockwise, refer to the relationship and movement of the components in the orientation illustrated in the drawings, which may not be the same for the components as attached to machinery. The term "directly connected" as used herein means that the associated hydraulic components are connected together by a conduit without any intervening element, such as a valve, an orifice or other device, which restricts or controls the flow of fluid beyond the inherent restriction of any conduit. As also used herein, components that are said to be "in fluid communication" are operatively connected in a manner wherein fluid flows between those components.

Operation of the cam phase actuator 12 requires significant oil pressure and flow from the engine oil pump to overcome the torque profile of the cam shaft and adjust the cam timing. In addition, the electrohydraulic valve 10 consumes electric current while placed into the center position the majority of the engine operating time. It is desirable to reduce hydraulic and electrical energy consumption and thereby improve efficiency of the cam phasing system.

SUMMARY OF THE INVENTION

In one aspect, some embodiments of the invention provide a control system for varying cylinder valve timing of an internal combustion engine is provided. The internal combustion engine includes a pump, a reservoir, a crankshaft, and a camshaft. The control system includes a cam phase actuator for adjusting a rotational phase of the camshaft relative to the crankshaft and having a first actuator port and a second actuator port. The control system further includes a first control valve having a first port operatively connected to receive fluid from the pump, a second port, and a first workport in fluid communication with the first port of the cam phase actuator. The first control valve having a first position in which fluid communication is provided between the first port and the first workport, and having a second position in which fluid communication is provided between the second port and the first workport. The control system further includes a second control valve having a third port operatively connected to receive fluid from the pump, a fourth port, and a second workport in fluid communication with the second actuator port. The second control valve having one position in which fluid communication is provided between the third port and the second workport, and having another position in which fluid communication is provided between the fourth port and the second workport. The control system further includes a dynamic regeneration valve configured to enable the cam phase actuator to switch between operating in an oil pressure actuated mode and a cam toque actuated mode when adjusting the rotational phase of the camshaft relative to the crankshaft.

In another aspect, some embodiments of the invention provide a control system for varying cylinder valve timing of an internal combustion engine is provided. The internal combustion engine includes a pump, a reservoir, a crankshaft, and a camshaft. The control system includes a cam phase actuator for adjusting a rotational phase of the camshaft relative to the crankshaft and having a first actuator port and a second actuator port. The control system further includes a first control valve having a first port operatively connected to receive fluid from the pump, a second port, and a first workport in fluid communication with the first port of the cam phase actuator. The first control valve having a first position in which fluid communication is provided between the first port and the first workport, and having a second position in which fluid communication is provided between the second port and the first workport. The control system further includes a second control valve having a third port operatively connected to receive fluid from the pump, a fourth port, and a second workport in fluid communication with the second actuator port. The second control valve having one position in which fluid communication is provided between the third port and the second workport, and having another position in which fluid communication is provided between the fourth port and the second workport. The control system further includes a dynamic regeneration valve configured to switch operation of the cam phase actuator between an oil pressure actuated mode and a cam torque actuated mode based on a pressure at an outlet of the pump.

BRIEF DESCRIPTION OF THE DRAWINGS

The following drawings depict examples of variable cam adjustment systems according to the present invention with the understanding that other components and hydraulic circuits may be employed to implement the present invention.

DETAILED DESCRIPTION OF THE INVENTION

Figure 3:
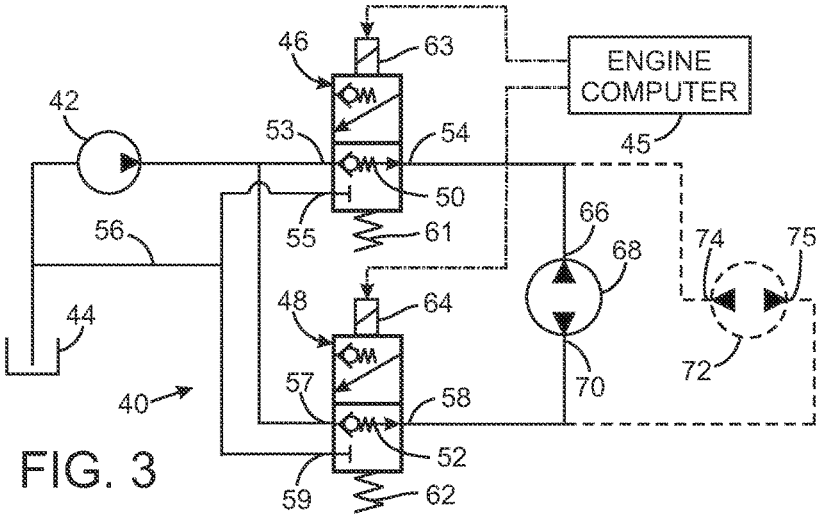
FIG. 3 is a schematic diagram of a first embodiment of a hydraulic circuit according to the present invention.

With initial reference to FIG. 3, a first cam phase control system 40 utilizes oil provided by a conventional oil pump 42 that furnishes oil from a reservoir 44 for lubricating the engine. The outlet of the oil pump 42 is connected to first and second control valves 46 and 48. Each of the control valves 46 and 48 is an electrohydraulic, on/off or proportional, three-way valve that is operated by a signal from an engine computer 45. In one implementation, the engine computer 45 applies a pulse width modulated (PWM) signal to operate an on/off, three-way valve to achieve proportional variation of fluid flow through the valve. Each exemplary control valve 46 or 48 includes an integrated check valve 50 or 52, respectively. The first control valve 46 has a first port 53 that receives oil from the outlet of the oil pump 42, and has a second port 55 in fluid communication with the reservoir 44 via a return line 56. When the first control valve 46 is in a first position as illustrated, a first path is provided between the first port 53 and a first workport 54. A first spring 61 biases the first control valve 46 toward the first position. The first check valve 50 allows oil to flow in the first path only from the first port 53 to the first workport 54 and prevents oil from flowing in the opposite direction. When a first solenoid actuator 63 is activated by an electric current from the engine computer 45, the first control valve 46 moves into a second position. In that second position, the first control valve 46 provides a bidirectional second path between the first workport 54 and the second port 55 and thus to the reservoir 44.

The second control valve 48 has a third port 57 connected to the outlet of the oil pump 42, and has a fourth port 59 that is connected to the reservoir 44 via the return line 56. In one position of the second control valve 48 that is illustrated, a third path is provided between the third port 57 and a second workport 58. A second spring 62 biases the second control valve 46 toward that one position. Fluid flow through the third path is restricted by the second check valve 52 to only a direction from the third port 57 to a second workport 58. Another position of the second control valve 48 provides a bidirectional fourth fluid path between the second workport 58 and the fourth port 59. An electric current from the engine controller activates a second solenoid actuator 64 to move the second control valve 48 into that other position.

Figure 1:
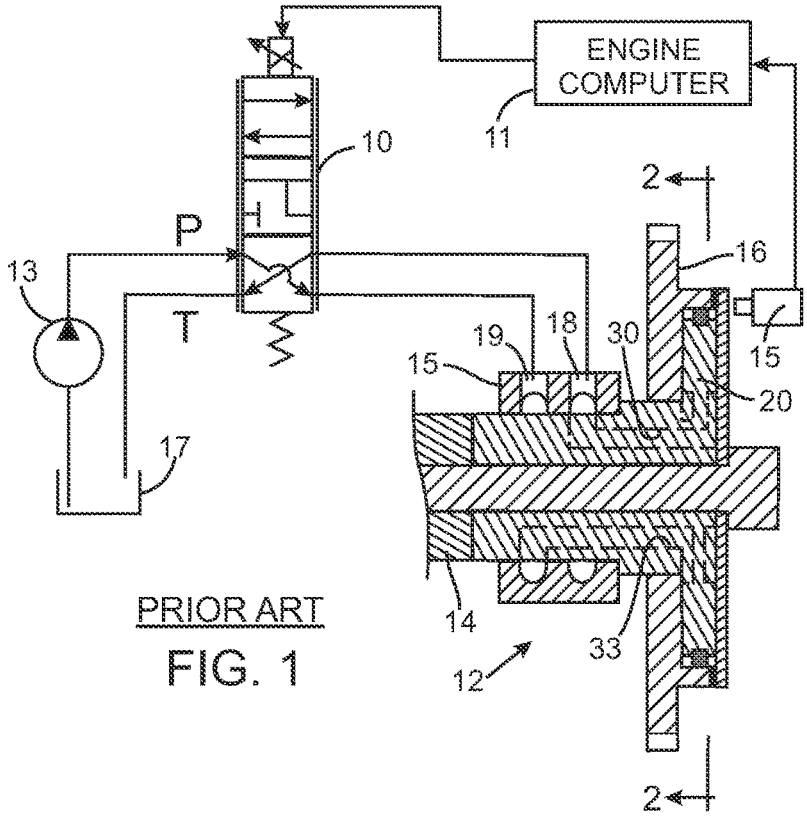
PRIOR ART FIG. 1
FIG. 1 is a schematic diagram of a previous variable cam adjustment system the included a cam phase actuator.
Figure 2:
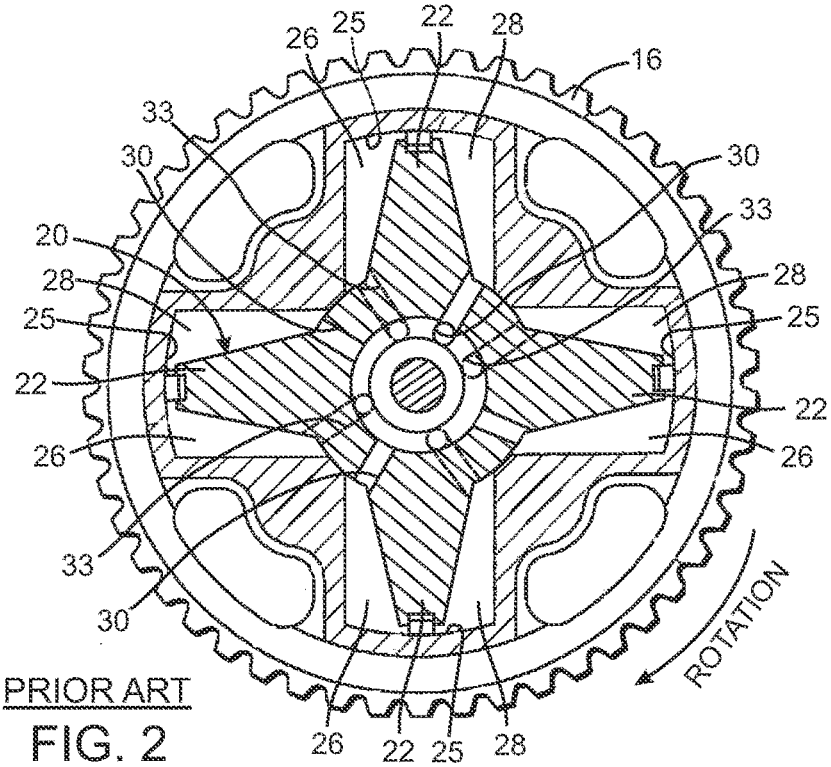
PRIOR ART FIG. 2
FIG. 2 is a cross section view along line 2-2 in FIG. 1 through the cam phase actuator.

The first cam phase control system 40 includes a cam phase actuator 68 for varying the rotational relationship between the crankshaft and the cam shaft of the engine. The cam phase actuator 68 is a conventional, hydraulically operated device used for that purpose and may be similar to the actuator shown in FIGS. 1 and 2. The cam phase actuator 68 has a first actuator port 66 that is directly connected to the first workport 54 of the first control valve 46, and has a second actuator port 70 that is directly connected to the second workport 58 of the second control valve 48.

When the engine computer is not applying current to the first and second solenoid actuators 63 and 64, the two control valves 46 and 48 are biased by the springs 61 and 62 into the positions illustrated in FIG. 3. In that state, equal pressure from the outlet of the oil pump 42 is applied to both actuator ports 66 and 70 of the cam phase actuator 68. Because the first and second check valves 50 and 52 in the first and second control valves 46 and 48 prevent oil from exiting the cam phase actuator 68, the actuator is held in the present phase position, even at slow engine speeds when the pump outlet pressure is low and even when the engine is turned off. Holding the cam phase actuators in the last operating position ensures that appropriate valve timing will be used when the engine is restarted, in spite of an initial slow speed with minimal oil pressure being produced by the pump 42.

De-energizing the first and second control valves 46 and 48 to hold the position of the cam phase actuator 68, as occurs the majority of time while the engine is operating, conserves both electrical power and hydraulic energy from the oil pump. Thus, the present cam phase control system consumes less energy than the previous system that employed a four-way control valve, as in FIG. 1.

Prior cam phase actuators also required a locking mechanism to hold the actuator in a fixed position when the cam phasing was not being adjusted. The first cam phase control system 40 does not require a locking mechanism, because when the cam phase actuator 68 is not being adjusted, the check valves 50 and 52 hold the oil within the cam phase actuator 68 and prevent the change in the cam phase relationship.

With continuing reference to FIG. 3, the first cam phase control system 40 provides bidirectional energy harvesting of cam torque for use in adjusting the cam phasing. This further conserves energy and enables adjustment of the cam phasing at near zero oil supply pressure.

To adjust the cam phase actuator 68 and advance the cylinder valve timing, the first control valve 46 remains de-energized while the second control valve 48 is operated into the position in which the second workport 58 is connected to the fourth port 59 to which the reservoir return line 56 connects. This enables pressurized fluid from the oil pump 42 to be fed into the first actuator port 66 and other fluid to be drained from the second actuator port 70 back to the reservoir 44. This causes the cam phase actuator 68 to change the phase relationship between crank shaft and the cam shaft and thereby advance the cylinder valve timing. When the cam phase reaches the desired angle, as detected by a sensor on the cam phase actuator, engine computer de-energizes the second solenoid actuator 64 which returns the second control valve 48 to the illustrated position in which the adjusted cam phase is maintained.

It should be understood that the engine cylinder valves exert torque onto the cam shaft that tends to alter the position relationship of the components in the cam phase actuator and thus the phase relationship between the crankshaft and the cam shaft. During certain segments of the revolution of the cam shaft, the net torque aids adjusting the cam phase in the desired direction thereby supplementing the adjustment force from the pump pressure. During other revolution segments, the net torque opposes the desired cam phase adjustment. Throughout those latter segments, the cam shaft torque tends to cause the cam phase actuator 68 to push oil backwards through the first control valve 46 to the oil pump 42. For example such backward flow may occur at low engine speeds, when the pump is producing a low output pressure. With the first cam phase control system 40, the first and second check valves 50 and 52 prevent that reverse flow, thereby enabling the system to operate effectively over a wider range of engine conditions, such as low pump output pressure, oil temperatures, and engine speeds. Thus, the present system takes advantage of the net cam shaft torque in rotational direction that aids adjustment of the cam phasing, while inhibiting the effect of adverse cam torque that opposes the desired cam phase adjustment. In other words, the present control system harvests the positive cam torque energy, while preventing the adverse effects of the negative cam torque energy.

This harvesting of cam torque for use in adjusting the cam phasing conserves energy and enables adjustment of the cam phasing at near zero oil supply pressure.

To adjust the cam phase actuator 68 to retard the cylinder valve timing, the first control valve 46 is electrically operated so that the first workport 54 is connected to the second port 55, thereby allowing fluid to be exhausted from the cam phase actuator to the reservoir 44. At the same time, the second control valve 48 is de-energized and thus is biased by the spring 62 into the illustrated position. At that position, oil from the pump 42 is applied to the second workport 58 and the second actuator port 70 of the cam phase actuator 68. In this state, the second check valve 52 enables harvesting of the positive cam torque energy while inhibiting the adverse effects of the negative cam torque energy.

It should be understood with respect to the circuit in FIG. 3 that the check valves 50 and 52 instead of being integrated into the first and second control valves 46 and 48, could be located outside those valves in the conduits that are connected to the respective first and third ports 53 and 57.

Figure 4:
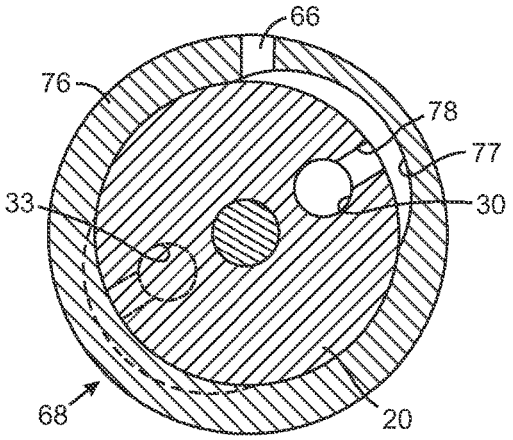
FIG. 4 is a radial cross section view through a cam phase actuator in the first embodiment.

Referring still to FIG. 3, if the engine has dual cam shafts, a second cam phase actuator 72 is provided for the other cam shaft and has actuator ports 74 and 75 connected to the 54 and 58, respectively, of the first and second control valves 46 and 48. The first and second cam phase actuators 68 and 72 are similar to the actuator 12 in FIGS. 1 and 2, except that the first passageway 30 communicates with the first actuator port and the second passageway 33 communicates with the second actuator port, during only a portion of each rotation of the cam shaft 14. With additional reference to FIG. 4 showing details of the first cam phase actuator 68, the first actuator port 66 in the actuator manifold 76 opens into an arcuate recess 77 that extends 90 degrees around the circumference of the bore in which the rotor 20 rotates. A radial aperture 78 in the rotor 20 extends from the outer circumferential surface to first passageway 30 that continues to the first cavities 26. The manifold's arcuate recess 77 and rotor's radial aperture 78 are arranged so that they are in fluid communication when the cam shaft is rotationally positioned between 0 degrees and 90 degrees. The second actuator port 70 of the first cam phase actuator 68 is similarly arranged to be in fluid communication with the second passageway 33, for the second cavities 28, when the cam shaft is between 0 and 90 degrees. One skilled in the art will appreciate that other angles and angle ranges may be used in controlling two or more cam phase actuators.

The second cam phase actuator 72 has a similar design, except that the arcuate recesses 77 are located so that the first and second actuator ports 74 and 75 communicate with the first and second passageways 30 and 33, respectively, when the cam shaft is between 180 degrees and 270 degrees during each rotation. Because of that angular offset of the arcuate recesses, the first and second cavities 26 and 28 of the first cam phase actuator 68 are actively connected to the control valve workports 54 and 58 at different times during each rotation of the cam shafts than when the first and second cavities 26 and 28 of the second cam phase actuator 72 are actively connected to the control valve workports. This enables the cam shaft phasing provided by the two cam phase actuators 68 and 72 to be controlled separately. When the dual cam shafts are between 0 degrees and 90 degrees, the control valves 46 and 48 are operated by the engine computer to vary the phasing of the first cam phase actuator 68; and when the dual cam shafts are between 180 degrees and 270 degrees, the control valves are operated to vary the phasing of the second cam phase actuator 72.

Figure 5:
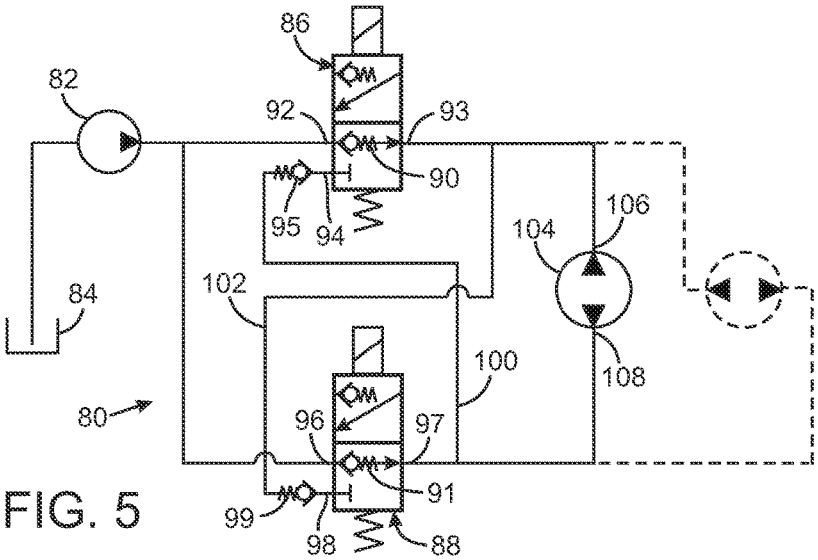
FIG. 5 is a schematic diagram of a second embodiment of a hydraulic circuit according to the present invention.

Referring to FIG. 5, a second embodiment of the present control system provides regeneration using fluid being exhausted from the cam phase actuator. This regenerative circuit reduces the amount of oil flow required from the pump to only that which is needed to replace fluid that leaks from the cam phase actuator and the control valves into the engine.

In the second cam phase control system 80, a conventional oil pump 82 feeds fluid from a reservoir 84 (e.g. the engine oil pan) to a pair of electrohydraulic, three-way control valves 86 and 88. The outlet of the oil pump 82 is connected to a first port 92 of the first control valve 86, that also has a second port 94 and a first workport 93. The first workport 93 is directly connected to a first actuator port 106 of a cam phase actuator 104 and the second port 94 is coupled to a second actuator port 108 by a first regeneration line 100. A third check valve 95 allows oil to flow through the first regeneration line 100 only in a direction from second port 94 to the second actuator port 108.

The outlet of the oil pump 82 also is connected to a third port 96 of the second control valve 88, that has a fourth port 98 and a second workport 97 as well. The second workport 97 is directly connected to the second actuator port 108 of the cam phase actuator 104, and the fourth port 98 is coupled to the first actuator port 106 by a second regeneration line 102. A fourth check valve 99 permits oil to flow through the second regeneration line 102 only in a direction from fourth port 98 to the first actuator port 106.

If the engine has multiple cam shafts, separate cam phase actuators are provided for each cam shaft and such actuators are coupled to the workports 93 and 97 of the two control valves 86 and 88 in the same manner as for the cam phase actuator 104.

When the two control valves 86 and 88 are de-energized, the second cam phase control system 80 functions the same as the first cam phase control system 40 when the both its control valves 46 and 48 are de-energized. When it is desired to advance the cylinder valve timing, the first control valve 86 remains de-energized and the second control valve 88 is electrically operated into the position that connects the second workport 97 to the fourth port 98. In this state, pressurized oil from the oil pump 82 is applied through the first control valve 86 to the first actuator port 106 of the cam phase actuator 104. At the same time, oil flows out of the second actuator port 108 through the second control valve 88, the fourth check valve 99, and the second regeneration line 102. The oil flowing through the second regeneration line 102 combines with the oil from the pump which is flowing out of the first workport 93. Therefore, the oil being exhausted from the second actuator port 108 is supplied in a regenerative manner to the first actuator port 106, thereby reducing the amount of flow required from the oil pump 82 to operate the cam phase actuator 104. This hydraulic regeneration reduces the amount energy consumed by the oil pump 82. In addition, the oil pump 82 does not have to be significantly increased in size, over that required to effectively lubricate the engine, in order for the pump also to supply the second cam phase control system 80.

Similarly, when it is desired to retard the cylinder valve timing, the first control valve 86 is energized to the position in which the first workport 93 is connected to the second port 94. At the same time, the second control valve 88 is maintained de-energized to provide a path that conveys pump output oil from the third port 96 to the second workport 97. In this mode of operation, oil exhausting from the first actuator port 106 of the cam phase actuator 104 is fed back in a regenerative manner through the first control valve 86, the third check valve 95 and the first regeneration line 100 to the second actuator port 108. That regenerative flow combines with any additional flow required from the oil pump 82 that is conveyed through the second control valve 88, to actuate the cam phase actuator 104.

The second embodiment in FIG. 5 could be varied by providing regeneration to only one of the actuator ports 106 or 108, but not to the other actuator port. For example, the first regeneration line 100 could be replaced by a line connecting the second port 94 of the first control valve 86 to the reservoir 84. In this variation, the flow out of the second port 94 is returned to the reservoir 84, while the flow out of the fourth port 98 of the second control valve 88 still flows through the second regeneration line 102 to the first actuator port 106.

As described above, the net torque acting on the camshaft can be used to provide cam phasing in the desired direction. When operating in a torque actuated mode, a cam phase control system only requires enough oil flow to make up for leakage and, therefore, does not substantially effect the pressure in the main oil galley of an engine. The main oil galley of an engine, typically located in the engine block, provides a passage way for oil to travel to many of the engine's main components, such as crank shaft bearings, cam gear(s)/bearing(s), and crank rod bearings to name a few. Thus, drastic changes in pressure in the main oil galley of an engine can result in insufficient oil being delivered to a main component of the engine and cause overheating and/or engine failure.

Figure 6:
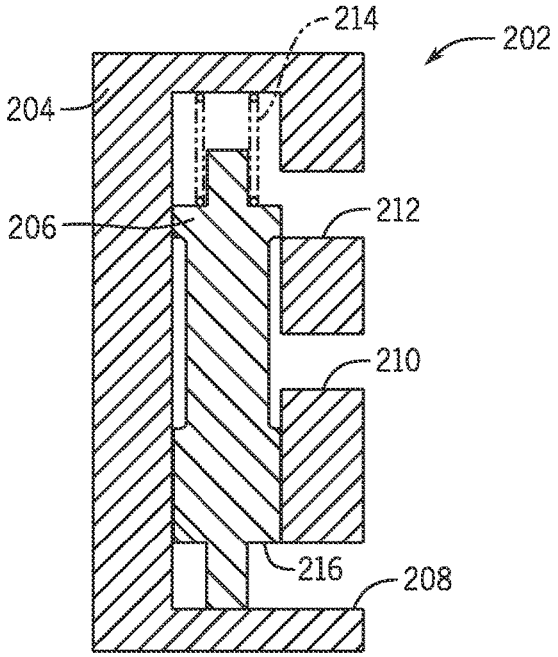
FIG. 6 is a cross-sectional view of a dynamic regeneration valve according to one embodiment of the present invention.
Figure 7:
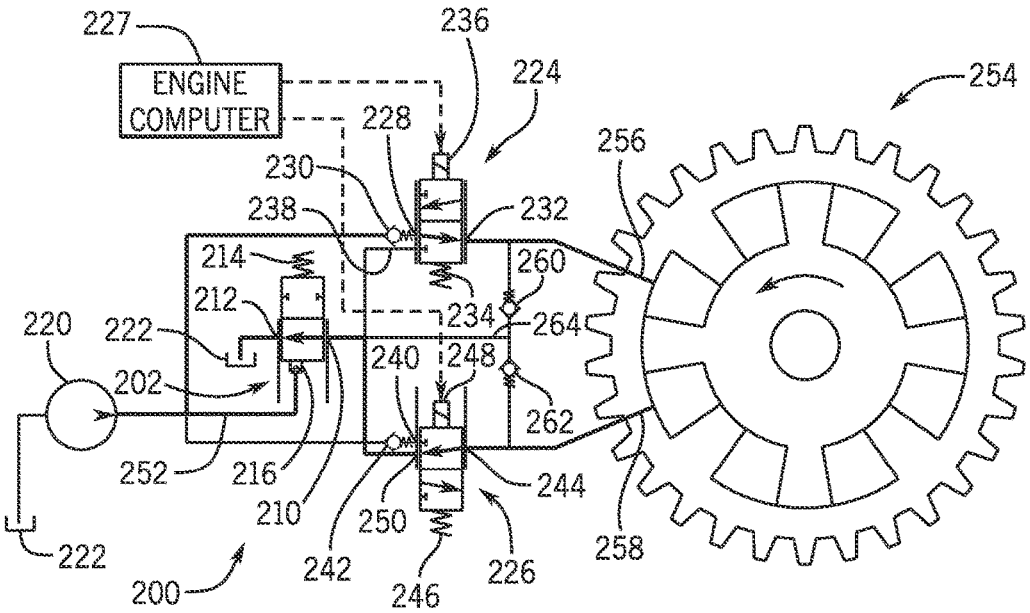
FIG. 7 is a schematic view of a third embodiment of a hydraulic circuit according to the present invention operating in an oil pressure actuated mode.

With reference to FIGS. 6 and 7, a third embodiment of a control system that provides a hybrid cam phase control system 200 that minimizes its impact on the pressure in the main oil galley of an engine by controlling when the hybrid cam phase control system 200 is operating in a cam torque actuated mode or an oil pressure actuated mode, as will be described in great detail below. The hybrid cam phase control system 200 can utilize a dynamic regeneration valve 202, shown in FIG. 6, which enables the hybrid cam phase control system 200 to switch between the cam torque actuated mode and the oil pressure actuated mode when adjusting the cylinder valve timing. The dynamic regeneration valve 202 includes a housing 204 and a valve member 206 arranged within the housing 204. The housing 204 defines a pressure port 208, a regeneration port 210, and a tank port 212. The valve member 206 illustrated in FIG. 6 is a spool. The valve member 206 is configured to be moveable between a first valve member position (FIG. 6)

where fluid communication between the regeneration port 210 and the tank port 212 is inhibited and a second valve member position where fluid communication is provided between the regeneration port 210 and the tank port 212. A regeneration spring 214 biases the valve member 206 towards the first valve member position. As the pressure at the pressure port 208 increases, a force acting on a bottom surface 216 of the valve member 206 will eventually overcome the force of the regeneration spring 214 and the valve member 206 will move from the first valve member position to the second valve member position.

With reference to FIG. 7, in the hybrid cam phase control system 200, a conventional oil pump 220 feeds fluid from a reservoir 222 (e.g., the engine oil pan) to a first control valve 224, a second control valve 226, and the dynamic regeneration valve 202. The first control valve 224 and the second control valve 226 are each electrohydraulic, three-way control valves operated by a signal from an engine computer 227. A first port 228 of the first control valve 224 is in fluid communication with the outlet of the oil pump 220, and a first check valve 230 is arranged between the outlet of the oil pump 220 and the first port 228. The first check valve 230 only allows oil to flow from the outlet of the oil pump 220 to the first port 228 and prevents oil from flowing in the opposite direction. In another embodiment, the first check valve 230 can be arranged within the first control valve 224, similar to check valves 50 and 90 described above.

When the first control valve 224 is in a first position illustrated in FIG. 7, the first control valve 224 provides fluid communication between the first port 228 and a first workport 232. The first control valve 224 is biased towards the first position by a first spring 234. When a first solenoid actuator 236 is energized by an electric current from the engine computer 227, the first solenoid actuator 236 overcomes the force of the first spring 234 and the first control valve 224 moves into a second position. In the second position, the first control valve 224 provides fluid communication between the first workport 232 and a second port 238. The second port 238 is in fluid communication with the regeneration port 210 of the dynamic regeneration valve 202.

A third port 240 of the second control valve 226 is in fluid communication with the outlet of the oil pump 220, and a second check valve 242 is arranged between the outlet of the oil pump 220 and the third port 240. The second check valve 242 only allows oil to flow from the outlet of the oil pump 220 to the third port 240 and prevents oil from flowing in the opposite direction. In another embodiment, the second check valve 242 can be arranged within the second control valve 226, similar to check valves 52 and 91 described above.

When the second control valve 226 is in one position, the second control valve 226 provides fluid communication between the third port 240 and a second workport 244. The second control valve 226 is biased towards that one position by a second spring 246. When a second solenoid actuator 248 is activated by an electric current from the engine computer 227, the second solenoid actuator 248 overcomes the force of the second spring 246 and the second control valve 226 moves into another position illustrated in FIG. 7. In that other position, the second control valve 226 provides fluid communication between the second workport 244 and a fourth port 250. The fourth port 250 is in fluid communication with the regeneration port 210 of the dynamic regeneration valve 202.

With continued reference to FIGS. 6 and 7, a sensing line 252 provides fluid communication between the pressure port 208 of the dynamic regeneration valve 202 and the outlet of the oil pump 220. When the pressure at the outlet of the oil pump 220 does not provide a force on the bottom surface 216 of the valve member 206 sufficient to overcome the force of the regeneration spring 214, the valve member 206 is forced into the first valve member position and the dynamic regeneration valve 202 inhibits fluid communication between the regeneration port 210 and the tank port 212 and thus to the reservoir 222. When the pressure at the outlet of the oil pump 220 reaches a sufficient level, the force acting on the bottom surface 216 of the valve member 206 overcomes the force of the regeneration spring 214 and the valve member 206 moves to the second valve member position illustrated in FIG. 7. In the second valve member position, the dynamic regeneration valve 202 provides fluid communication between the regeneration port 210 and the tank port 212 and thus to the reservoir 222.

The hybrid cam phase control system 200 includes a cam phase actuator 254 for varying the rotational relationship between the crankshaft and the cam shaft of the engine. The cam phase actuator 254 can be a conventional, hydraulically actuated device similar to the actuator shown in FIGS. 1 and 2. Alternatively or additionally, the cam phase actuator 254 can be configured to operate similar to the cam phase actuator 68 shown in FIG. 4 and described above. The cam phase actuator 254 includes a first actuator port 256 in fluid communication with the first workport 232 and a second actuator port 258 in fluid communication with the second workport 244. The hybrid cam phase control system 200 also includes a third check valve 260, a fourth check valve 262, and a re-circulation line 264. The third check valve 260 inhibits fluid communication between the first workport 232 and the re-circulation line 264, and also inhibits fluid communication between the first actuator port 256 and the re-circulation line 264. The fourth check valve 262 inhibits fluid communication between the second workport 244 and the re-circulation line 264, and also inhibits fluid communication between the second actuator port 258 and the re-circulation line 264. The re-circulation line 264 provides fluid communication between the second port 238 and the second actuator port 258, and provides fluid communication between the fourth port 250 and the first actuator port 256.

Figure 8:
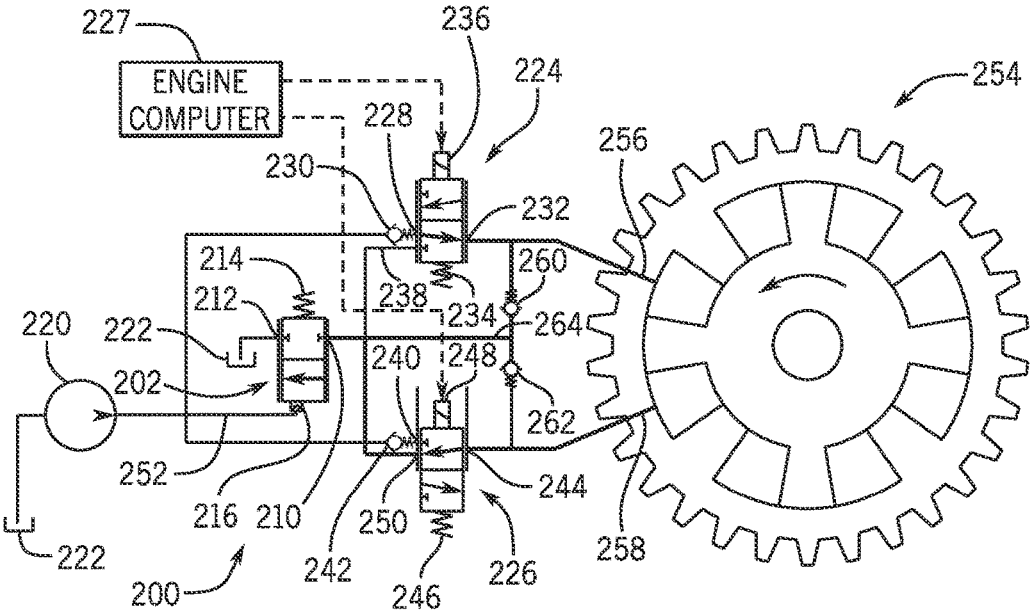
FIG. 8 is a schematic view of the hydraulic circuit of FIG. 7 operating in a cam torque actuated mode.

Operation of the hybrid cam phase control system 200 will be described with reference to FIGS. 6-8. It should be understood that the following description of advancing and retarding the cylinder valve timing is for one rotational direction of the crankshaft and, for another rotational direction of the crankshaft, the operation of the first control valve 224 and the second control valve 226 will be opposite. Thus, the following description is one non-liming example of the operation of the hybrid cam phase control system 200.

The hybrid cam phase control system 200 can adjust the cam phase actuator 254 using either the cam torque actuated mode or the oil pressure actuated mode. Whether the hybrid cam phase control system 200 is operating in the cam torque actuated mode or the oil pressure actuated mode, operation of the first control valve 224 and the second control valve 226 will be the same for the two modes when adjusting the cam phase actuator 254 to advance or retard the cylinder valve timing.

To adjust the cam phase actuator 254 and advance the cylinder valve timing, the first solenoid actuator 236 is de-energized such that the first control valve 224 provides fluid communication between the first port 228 and the first workport 232, and the second solenoid actuator 248 is energized such that the second control valve 226 provides fluid communication between the second workport 244 and the fourth port 250. This enables oil from the oil pump 220 to be fed into the first actuator port 256 and other oil to be drained from the second actuator port 258 back to the reservoir 222.

To adjust the cam phase actuator 254 and retard the cylinder valve timing, the first solenoid actuator 236 is energized such that the first control valve 224 provides fluid communication between the first workport 232 and the second port 238, and the second solenoid actuator 248 is de-energized such that the second control valve 226 provides fluid communication between the third port 240 and the second workport 244. This enables oil from the oil pump 220 to be fed into the second actuator port 258 and other oil to be drained from the first actuator port 256 back to the reservoir 222.

Switching between the cam torque actuated mode and the oil pressure actuated mode is governed by the pressure at the outlet of the oil pump 220. When the pressure at the outlet of the oil pump 220, sensed by the sensing line 252, provides a force on the bottom surface 216 of the valve member 206 that overcomes the force of the regeneration spring 214, the hybrid cam phase control system 200 will be operating in the oil pressure actuated mode and pressurized oil provided by the oil pump 220 will be adjusting the cam phase actuator 254. In the oil pressure actuated mode, the valve member 206 is forced into the second valve member position and oil flowing from either the first workport 238 or the second workport 250 (depending on whether the cylinder valve timing is being advanced or retarded) is allowed to flow though the dynamic regeneration valve 202 to the reservoir 222. For example, when the cam phase actuator 254 is adjusted to advance the cylinder valve timing, pressurized oil is fed from the pump 220 through the first control valve 224 to the first actuator port 256. The oil exhausted from the second actuator port 258 is fed through the second control valve 226 and the dynamic regeneration valve 202 to the reservoir 222, as shown in bold lines in FIG. 7.

When the pressure at the outlet of the oil pump 220, sensed by the sensing line 252, does not provide a force on the bottom surface 216 of the valve member 206 sufficient to overcome the force of the regeneration spring 214, the hybrid cam phase control system 200 will be operating in the cam torque actuated mode and the net force acting on the camshaft will be used to adjust the cam phase actuator 254. In the cam torque actuated mode, the valve member 206 is biased into the first valve member position and oil is re-circulated through the hybrid cam phase control system 200. For example, when the net torque on the cam shaft adjusts the cam phase actuator 254 to advance the cylinder valve timing, oil from the oil pump 220 can be fed into the first actuator port 256 and oil exhausted from the second actuator port 258 is fed through the second control valve 226, the re-circulation line 264, and the third check valve 260, as shown in bold lines in FIG. 8. The oil flowing through the re-circulation line 264 and the third check valve 260 is fed back to the first actuator port 256. Thus, the oil exhausted from the second actuator port 258 is re-circulated to the first actuator port 256 and the oil pump 220 only needs to supply enough oil to the first port 228 to make up for leakage. This minimizes the effect the hybrid cam phase control system 200 has on the pressure in the reservoir 222 and enables the adjustment of the cam phase actuator 254 at low oil pump pressures.

Figure 9:
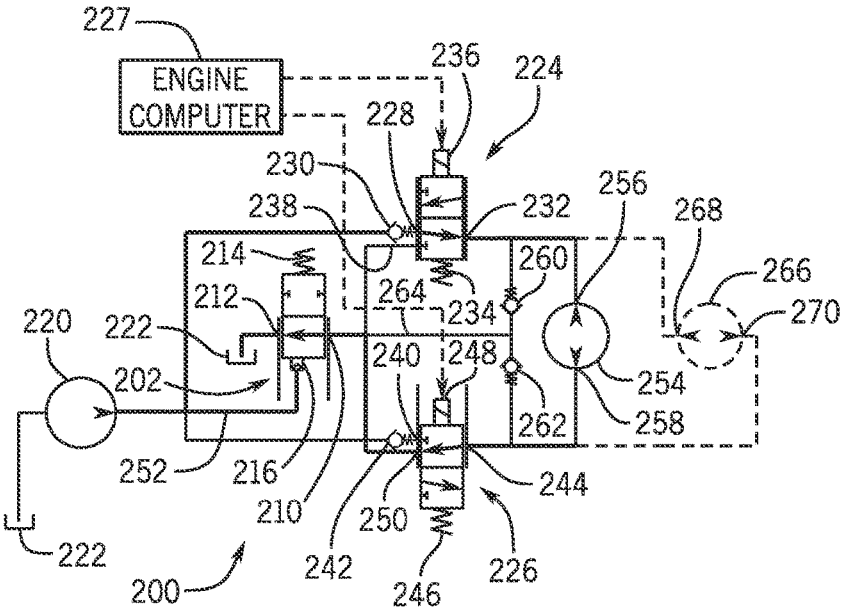
FIG. 9 is a schematic view of the hydraulic circuit of FIG. 7 illustrating the use of dual cam shafts.

If the engine has dual cam shafts, a second cam phase actuator 266 is provided for the other cam shaft as shown in FIG. 9. The second cam phase actuator 266 includes one actuator port 268 in fluid communication with the first workport 232 and another actuator port 270 in fluid communication with the second workport 244. In this embodiment, the cam phase actuators 254 and 266 can be designed similar to the cam phase actuators 68 and 72, described above. For example, the cam phase actuator 254 can be designed such that the first and second actuator ports 256 and 258 can be in communication with the first and second passageways 30 and 33 when the cam shaft is rotationally positioned between 0 degrees and 90 degrees. Additionally, the second cam phase actuator can be designed such that the actuator ports 268 and 270 can be in communication with the first and second passageways 30 and 33 when the cam shaft is rotationally positioned between 180 degrees and 270 degrees. One skilled in that art will appreciate that other angles and angle ranges may be used in controlling two or more cam phase actuators.

Figure 10:
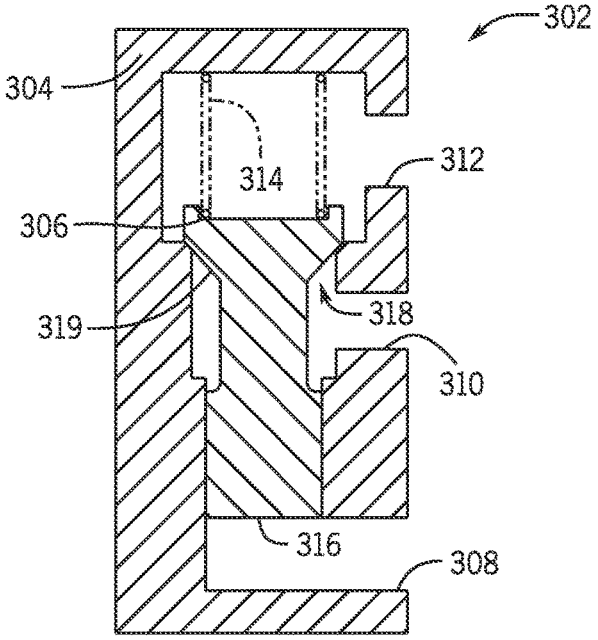
FIG. 10 is a cross-sectional view of a dynamic regeneration valve according to another embodiment of the present invention.
Figure 11:
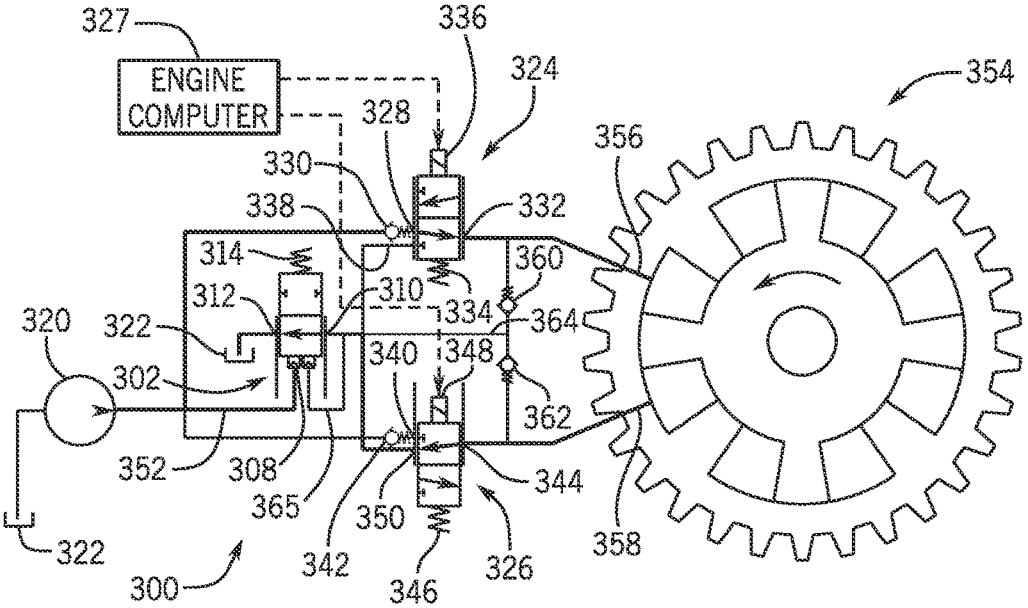
FIG. 11 is a schematic view of a fourth embodiment of a hydraulic circuit according to the present invention operating in an oil pressure actuated mode.

With reference to FIGS. 10 and 11, a fourth embodiment of a control system that provides a hybrid cam phase control system 300 that minimizes its impact on the pressure in the main oil galley of an engine by controlling when the hybrid cam phase control system 300 is operating in a cam torque actuated mode or an oil pressure actuated mode, as will be described in great detail below. The hybrid cam phase control system 300 can utilize a dynamic regeneration valve 302, shown in FIG. 10, which enables the hybrid cam phase control system 300 to switch between the cam torque actuated mode and the oil pressure actuated mode when adjusting the cylinder valve timing. The dynamic regeneration valve 302 includes a housing 304 and a valve member 306 arranged within the housing 304. The housing 304 defines a pressure port 308, a regeneration port 310, and a tank port 312. The valve member 306 illustrated in FIG. 11 is a poppet. The valve member 306 is configured to be moveable between a first valve member position (FIG. 11) where fluid communication is inhibited between the regeneration port 310 and the tank port 312 and a second valve member position where fluid communication is provided between the regeneration port 310 and the tank port 312. A regeneration spring 314 biases the valve member 306 towards the first valve member position. The valve member 306 includes a lower surface 316 in fluid communication with the pressure port 308 and central portion 318 in fluid communication with the regeneration port 310. The central portion 318 defines a differential area 319. As the pressure at the pressure port 308 increases, a force acting on a bottom surface 316 of the valve member 306 will eventually overcome the force of the regeneration spring 314 and the valve member 306 will move from the first valve member position to the second valve member position.

With reference to FIG. 11, in the hybrid cam phase control system 300, a conventional oil pump 320 feeds fluid from a reservoir 322 (e.g., the engine oil pan) to a first control valve 324, a second control valve 326, and the dynamic regeneration valve 302. The first control valve 324 and the second control valve 326 are each electrohydraulic, three-way control valves operated by a signal from an engine computer 327. A first port 328 of the first control valve 324 is in fluid communication with the outlet of the oil pump 320, and a first check valve 330 is arranged between the outlet of the oil pump 320 and the first port 328. The first check valve 330 only allows oil to flow from the outlet of the oil pump 320 to the first port 328 and prevents oil from flowing in the opposite direction. In another embodiment, the first check valve 330 can be arranged within the first control valve 324, similar to check valves 50 and 90 described above.

When the first control valve 324 is in a first position illustrated in FIG. 11, the first control valve 324 provides fluid communication between the first port 328 and a first workport 332. The first control valve 324 is biased towards the first position by a first spring 334. When a first solenoid actuator 336 is energized by an electric current from the engine computer 327, the first solenoid actuator 336 overcomes the force of the first spring 334 and the first control valve 324 moves into a second position. In the second position, the first control valve 324 provides fluid communication between the first workport 332 and a second port 338. The second port 338 is in fluid communication with the regeneration port 310 of the dynamic regeneration valve 302.

A third port 340 of the second control valve 326 is in fluid communication with the outlet of the oil pump 320, and a second check valve 342 is arranged between the outlet of the oil pump 320 and the third port 340. The second check valve 342 only allows oil to flow from the outlet of the oil pump 320 to the third port 340 and prevents oil from flowing in the opposite direction. In another embodiment, the second check valve 342 can be arranged within the second control valve 326, similar to check valves 52 and 91 described above.

When the second control valve 326 is in one position, the second control valve 326 provides fluid communication between the third port 340 and a second workport 344. The second control valve 326 is biased towards that one position by a second spring 346. When a second solenoid actuator 348 is activated by an electric current from the engine computer 327, the second solenoid actuator 348 overcomes the force of the second spring 346 and the second control valve 326 moves into another position illustrated in FIG. 11. In that other position, the second control valve 326 provides fluid communication between the second workport 344 and a fourth port 350. The fourth port 350 is in fluid communication with the regeneration port 310 of the dynamic regeneration valve 302.

With continued reference to FIGS. 10 and 11, a sensing line 352 provides fluid communication between the pressure port 308 of the dynamic regeneration valve 302 and the outlet of the oil pump 320. When the pressure at the outlet of the oil pump 320 does not provide a force on the bottom surface 316 of the valve member 306 sufficient to overcome the force of the regeneration spring 314, the valve member 306 is forced into the first valve member position and the dynamic regeneration valve 302 inhibits fluid communication between the regeneration port 310 and the tank port 312 and thus to the reservoir 322. When the pressure at the outlet of the oil pump 320 reaches a sufficient level, the force acting on the bottom surface 316 of the valve member 306 overcomes the force of the regeneration spring 314 and the valve member 306 moves to the second valve member position illustrated in FIG. 11. In the second valve member position, the dynamic regeneration valve 302 provides fluid communication between the regeneration port 310 and the tank port 312 and thus to the reservoir 322.

The hybrid cam phase control system 300 includes a cam phase actuator 354 for varying the rotational relationship between the crankshaft and the cam shaft of the engine. The cam phase actuator 354 can be a conventional, hydraulically actuated device similar to the actuator shown in FIGS. 1 and 2. Alternatively or additionally, the cam phase actuator 354 can be configured to operate similar to the cam phase actuator 68 shown in FIG. 4 and described above. The cam phase actuator 354 includes a first actuator port 356 in fluid communication with the first workport 332 and a second actuator port 358 in fluid communication with the second workport 344. The hybrid cam phase control system 300 also includes a third check valve 360, a fourth check valve 362, and a re-circulation line 364. The third check valve 360 inhibits fluid communication between the first workport 332 and the re-circulation line 364, and also inhibits fluid communication between the first actuator port 356 and the re-circulation line 364. The fourth check valve 362 inhibits fluid communication between the second workport 344 and the re-circulation line 364, and also inhibits fluid communication between the second actuator port 358 and the re-circulation line 364. The re-circulation line 364 provides fluid communication between the second port 338 and the second actuator port 358, and also provides fluid communication between the fourth port 350 and the first actuator port 356.

Operation of the hybrid cam phase control system 300 will be described with reference to FIGS. 10-13. It should be understood that the following description of advancing and retarding the cylinder valve timing is for one rotational direction of the crankshaft and, for another rotational direction of the crankshaft, the operation of the first control valve 324 and the second control valve 326 will be opposite. Thus, the following description is one non-liming example of the operation of the hybrid cam phase control system 300.

The hybrid cam phase control system 300 can adjust the cam phase actuator 354 using either the cam torque actuated mode or the oil pressure actuated mode. Whether the hybrid cam phase control system 300 is operating in the cam torque actuated mode or the oil pressure actuated mode, operation of the first control valve 324 and the second control valve 326 will be the same for the two modes when adjusting the cam phase actuator 354 to advance or retard the cylinder valve timing.

To adjust the cam phase actuator 354 and advance the cylinder valve timing, the first solenoid actuator 336 is de-energized such that the first control valve 324 provides fluid communication between the first port 328 and the first workport 332, and the second solenoid actuator 348 is energized such that the second control valve 326 provides fluid communication between the second workport 344 and the fourth port 350. This enables oil from the oil pump 320 to be fed into the first actuator port 356 and other oil to be drained from the second actuator port 358 back to the reservoir 322.

To adjust the cam phase actuator 354 and retard the cylinder valve timing, the first solenoid actuator 336 is energized such that the first control valve 324 provides fluid communication between the first workport 332 and the second port 338, and the second solenoid actuator 348 is de-energized such that the second control valve 326 provides fluid communication between the third port 340 and the second workport 344. This enables oil from the oil pump 320 to be fed into the second actuator port 358 and other oil to be drained from the first actuator port 356 back to the reservoir 322.

Switching between the cam torque actuated mode and the oil pressure actuated mode is governed by the pressure at the outlet of the oil pump 320. When the pressure at the outlet of the oil pump 320, sensed by the sensing line 352, provides a force on the bottom surface 316 of the valve member 306 that overcomes the force of the regeneration spring 314, the hybrid cam phase control system 300 will be operating in the oil pressure actuated mode and pressurized oil provided by the oil pump 320 will be used to adjust the cam phase actuator 354. In the oil pressure actuated mode, the valve member 306 is forced into the second valve member position and oil flowing from either the first workport 338 or the second workport 350 (depending on whether the cylinder valve timing is being advanced or retarded) is allowed to flow though the dynamic regeneration valve 302 to the reservoir 322. For example, when the cam phase actuator 354 is adjusted to advance the cylinder valve timing, pressurized oil is fed from the pump 320 through the first control valve 324 to the first actuator port 356. The oil exhausted from the second actuator port 358 is fed through the second control valve 326 and the dynamic regeneration valve 302 to the reservoir 322, as shown in bold lines in FIG. 11.

Figure 12:
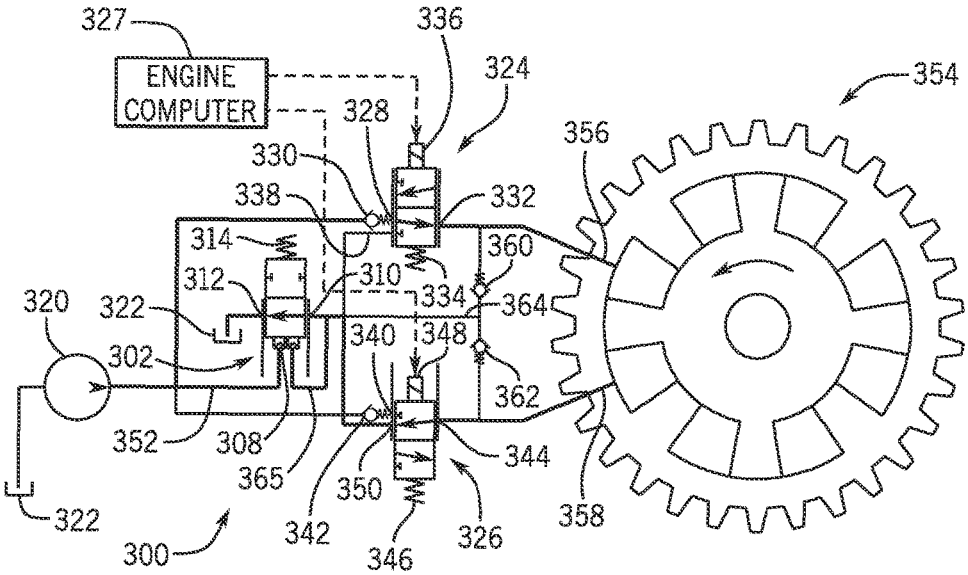
FIG. 12 is a schematic view of the hydraulic circuit of FIG. 11 illustrating elevated pressure at a regeneration port.
Figure 13:
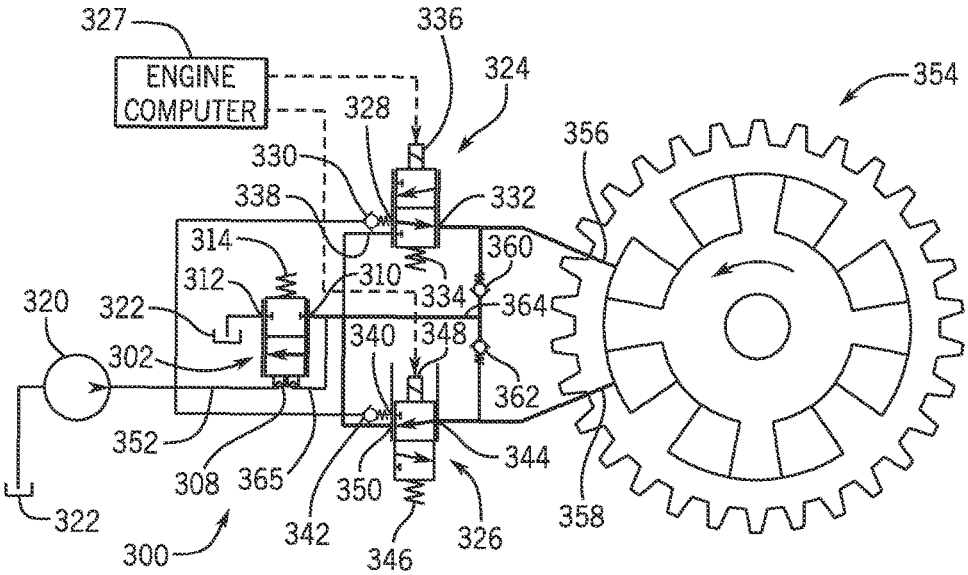
FIG. 13 is a schematic view of the hydraulic circuit of FIG. 11 operating in a cam torque actuated mode.

As described above, the valve member 306 is in the second valve member position while the hybrid cam phase control system 300 is operating in the oil pressure assisted mode. During this operation, the differential area 319 defined by the central portion 318 of the valve member 306 enables the valve member 306 to increase or decrease a flow area between the regeneration port 310 and the tank port 312 in response to the pressure at the regeneration port 310. For example, if there is a spike in the pressure at the regeneration port 310, the illustrated differential area 319 enables the valve member 306 to increase the flow area between the regeneration port 310 and the tank port 312 as the valve member 306 lifts in response to the pressure spike. This functionality of the valve member 306 is illustrated by a regeneration sensing line 365 in FIGS. 11-14. In particular, FIG. 12 illustrates, in bold lines, the above described example where the hybrid cam phase control system 300 is operating in the oil pressure actuated mode and the pressure at the regeneration port 310 further forces the valve member 306 to lift and increase the flow area between the regeneration port 310 and the tank port 312.

One skilled in the art will appreciate that the differential area 319 may be designed to either provide additional flow area between the regeneration port 310 and the tank port 312 during a spike in pressure at the regeneration port 310 or provide additional closing of the flow area between the regeneration port 310 and the tank port 312 during a spike in pressure at the regeneration port 310, compared to the differential area 319 illustrated in FIG. 10. Thus, the differential area 319 can be designed to reduce the resistance of the hydraulic circuit illustrated in FIGS. 11-14 and provide faster shifting rates by providing additional flow area. Alternatively, the differential area 319 can be designed to ensure that the hybrid cam phase control system 300 will default to the oil pressure actuated mode if consistent pressure spikes at the regeneration port 310 stop occurring.

When the pressure at the outlet of the oil pump 320, sensed by the sensing line 352, does not provide a force on the bottom surface 316 of the valve member 306 sufficient to overcome the force of the regeneration spring 314, the hybrid cam phase control system 300 will be operating in the cam torque actuated mode and the net force acting on the camshaft will be used to adjust the cam phase actuator 354. In the cam torque actuated mode, the valve member 306 is biased into the first valve member position and oil is re-circulated through the hybrid cam phase control system 300. For example, when the net torque on the cam shaft adjusts the cam phase actuator 354 to advance the cylinder valve timing, oil from the oil pump 320 can be fed into the first actuator port 356 and oil exhausted from the second actuator port 358 is fed through the second control valve 326, the re-circulation line 364, and the third check valve 360, as shown in bold lines in FIG. 13. The oil flowing through the re-circulation line 364 and the third check valve 360 is fed back to the first actuator port 356. Thus, the oil exhausted from the second actuator port 358 is re-circulated to the first actuator port 356 and the oil pump 320 only needs to supply enough oil to the first port 328 to make up for leakage. This minimizes the effect the hybrid cam phase control system 300 has on the pressure in the reservoir 222 and enables the adjustment of the cam phase actuator 354 at low oil pump pressures.

Figure 14:
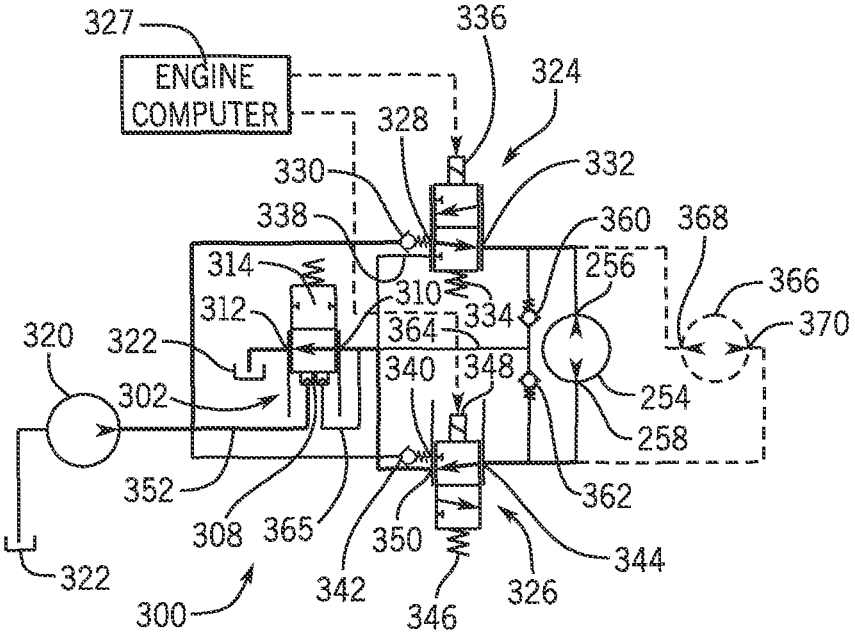
FIG. 14 is a schematic view of the hydraulic circuit of FIG. 11 illustrating the use of dual cam shafts.

If the engine has dual cam shafts, a second cam phase actuator 366 is provided for the other cam shaft as shown in FIG. 14. The second cam phase actuator 366 includes one actuator port 368 in fluid communication with the first workport 332 and another actuator port 370 in fluid communication with the second workport 344. In this embodiment, the cam phase actuators 354 and 366 can be designed similar to the cam phase actuators 68 and 72, described above. For example, the cam phase actuator 354 can be designed such that the first and second actuator ports 356 and 358 can be in communication with the first and second passageways 30 and 33 when the cam shaft is rotationally positioned between 0 degrees and 90 degrees. Additionally, the second cam phase actuator can be designed such that the actuator ports 368 and 370 can be in communication with the first and second passageways 30 and 33 when the cam shaft is rotationally positioned between 180 degrees and 270 degrees. One skilled in that art will appreciate that other angles and angle ranges may be used in controlling two or more cam phase actuators.

The foregoing description was primarily directed to one or more embodiments of the invention. Although some attention has been given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A control system for varying cylinder valve timing of an internal combustion engine, the internal combustion engine includes a pump, a reservoir, a crankshaft, and a camshaft; said control system comprising:

a cam phase actuator for adjusting a rotational phase of the camshaft relative to the crankshaft and having a first actuator port and a second actuator port;

a first control valve comprising a first port operatively connected to receive fluid from the pump, a second port, and a first workport in fluid communication with the first port of the cam phase actuator, the first control valve having a first position in which fluid communication is provided between the first port and the first workport, and having a second position in which fluid communication is provided between the second port and the first workport;

a second control valve comprising a third port operatively connected to receive fluid from the pump, a fourth port, and a second workport in fluid communication with the second actuator port, the second control valve having one position in which fluid communication is provided between the third port and the second workport, and having another position in which fluid communication is provided between the fourth port and the second workport; and a dynamic regeneration valve including a housing and a valve member received within the housing and moveable between a first valve member position and a second valve member position, wherein the housing defines a pressure port, a regeneration port, and a tank port, and wherein the dynamic regen valve is configured to enable the cam phase actuator to switch between operating in an oil pressure actuated mode and a cam torque actuated mode when adjusting the rotational phase of the camshaft relative to the crankshaft.

2. The control system as recited in claim 1 wherein when the cam phase actuator is operating in the cam torque actuated mode, the valve member is in the first valve member position where fluid communication is inhibited between the regeneration port and the tank port.

3. The control system as recited in claim 1 wherein when the cam phase actuator is operating in the oil pressure actuated mode, the valve member is in the second valve member position where fluid communication is provided between the regeneration port and the tank port.

4. The control system as recited in claim 1 wherein the valve member is a spool.

5. The control system as recited in claim 1 wherein the valve member is a poppet.

6. The control system as recited in claim 1 wherein the valve member includes a portion defining a differential area.

7. The control system as recited in claim 6 wherein when the valve member is in the second valve member position, the differential area enables the valve member to increase or decrease a flow area between the regeneration port and the tank port.

8. The control system as recited in claim 1 further comprising a first check valve operatively connected to restrict fluid to flow only in a direction from the pump to the first port.

9. The control system as recited in claim 8 further comprising a second check valve operatively connected to restrict fluid to flow only in a direction from the pump to the third port.

10. The control system as recited in claim 1 wherein the second port of the first control valve is in fluid communication with the second actuator port.

11. The control system as recited in claim 10 further comprising a third check valve operatively connected to restrict fluid to flow only in a direction from the second port of the first control valve to the second actuator port.

12. The control system as recited in claim 1 wherein the fourth port of the second control valve is in fluid communication with the first actuator port.

13. The control system as recited in claim 12 further comprising a fourth check valve operatively connected to restrict fluid to flow only in a direction from the fourth port of the second control valve to the first actuator port.

14. The control system as recited in claim 1 wherein the second port of the first control valve and the fourth port of the second control valve are in fluid communication with the regeneration port.

15. The control system as recited in claim 1 wherein the tank port is in fluid communication with the reservoir.

16. The control system as recited in claim 1 wherein the pressure port is in fluid communication an outlet of the pump.

17. The control system as recited in claim 1 wherein the valve member is biased into the first spool position by a spring.

18. The control system as recited in claim 1 wherein the first control valve and the second control valve are both three-way valves.

19. The control system as recited in claim 1 further comprising a second cam phase actuator having one actuator port in fluid communication with the first workport and another actuator port in fluid communication with the second workport, wherein phasing of the first cam phase actuator is varied during a first range of angles during rotation of the cam shaft and phasing of the second cam phase actuator is varied during a second range of angles during rotation of the cam shaft.

20. A control system for varying cylinder valve timing of an internal combustion engine, the internal combustion engine includes a pump, a reservoir, a crankshaft, and a camshaft; said control system comprising:

a cam phase actuator for adjusting a rotational phase of the camshaft relative to the crankshaft and having a first actuator port and a second actuator port;

a first control valve comprising a first port operatively connected to receive fluid from the pump, a second port, and a first workport in fluid communication with the first port of the cam phase actuator, the first control valve having a first position in which fluid communication is provided between the first port and the first workport, and having a second position in which fluid communication is provided between the second port and the first workport;

a second control valve comprising a third port operatively connected to receive fluid from the pump, a fourth port, and a second workport in fluid communication with the second actuator port, the second control valve having one position in which fluid communication is provided between the third port and the second workport, and having another position in which fluid communication is provided between the fourth port and the second workport; and a dynamic regeneration valve configured to switch operation of the cam phase actuator between an oil pressure actuated mode and a cam torque actuated mode based on a pressure at an outlet of the pump.

21. The control system as recited in claim 20 wherein the dynamic regeneration valve comprises a housing and a valve member received within the housing and moveable between a first valve member position and a second valve member position, the housing defining a pressure port, a regeneration port, and a tank port.

22. The control system as recited in claim 21 wherein when the valve member is in the first valve member position fluid communication is inhibited between the regeneration port and the tank port.

23. The control system as recited in claim 21 wherein when the valve member is in the second valve member position fluid communication is provided between the regeneration port and the tank port.

24. The control system as recited in claim 21 wherein the valve member is biased towards the first valve member position by a biasing member.

25. The control system as recited in claim 24 wherein the biasing member is a spring.

26. The control system as recited in claim 24 wherein when the cam phase actuator is operating in the cam torque actuated mode, the pressure at the outlet of the pump does not provide a force on the valve member sufficient to overcome a force of the biasing member and the valve member is biased towards the first valve member position by the biasing member.

27. The control system as recited in claim 24 wherein when the cam phase actuator is operating in the oil pressure actuated mode, the pressure at the outlet of the pump provides a force on the valve member sufficient to overcome a force of the biasing member and the valve member is moved to the second valve member position.

28. The control system as recited in claim 21 wherein the valve member includes a portion defining a differential area.

29. The control system as recited in claim 28 wherein when the valve member is in the second valve member position, the differential area enables the valve member to increase or decrease a flow area between the regeneration port and the tank port in response to changes in the pressure at the outlet of the pump and/or changes in a pressure at the regeneration port.

30. The control system as recited in claim 20 further comprising a first check valve operatively connected to restrict fluid to flow only in a direction from the pump to the first port.

31. The control system as recited in claim 30 further comprising a second check valve operatively connected to restrict fluid to flow only in a direction from the pump to the third port.

32. The control system as recited in claim 20 wherein the second port of the first control valve is in fluid communication with the second actuator port.

33. The control system as recited in claim 32 further comprising a third check valve operatively connected to restrict fluid to flow only in a direction from the second port of the first control valve to the second actuator port.

34. The control system as recited in claim 20 wherein the fourth port of the second control valve is in fluid communication with the first actuator port.

35. The control system as recited in claim 34 further comprising a fourth check valve operatively connected to restrict fluid to flow only in a direction from the fourth port of the second control valve to the first actuator port.

36. The control system as recited in claim 21 wherein the second port of the first control valve and the fourth port of the second control valve are in fluid communication with the regeneration port.

37. The control system as recited in claim 21 wherein the tank port is in fluid communication with the reservoir.

38. The control system as recited in claim 21 wherein the pressure port is in fluid communication an outlet of the pump.

39. The control system as recited in claim 20 wherein the first control valve and the second control valve are both three-way valves.

40. The control system as recited in claim 20 further comprising a second cam phase actuator having one actuator port in fluid communication with the first workport and another actuator port in fluid communication with the second workport, wherein phasing of the first cam phase actuator is varied during a first range of angles during rotation of the cam shaft and phasing of the second cam phase actuator is varied during a second range of angles during rotation of the cam shaft.

41. A control system for varying cylinder valve timing of an internal combustion engine, the internal combustion engine includes a pump, a reservoir, a crankshaft, and a camshaft; said control system comprising:

a cam phase actuator for adjusting a rotational phase of the camshaft relative to the crankshaft and having a first actuator port and a second actuator port;

at least one control valve including at least two ports, the at least one control valve to selectively provide fluid communication between one or more of the pump and the first actuator port, the pump and the second actuator port, the first actuator port and the reservoir, and the second actuator port and the reservoir; and a dynamic regeneration valve arranged between one of the at least two ports and the reservoir, wherein the dynamic regeneration valve is configured to switch operation of the cam phase actuator between an oil pressure actuated mode and a cam torque actuated mode based on a pressure at an outlet of the pump.

* * * * *